United States Patent [19]

Matsuura

[11] 4,418,916

[45] Dec. 6, 1983

[54] TILT TOP GULF TEE

[76] Inventor: Norio Matsuura, 6-10-16, Mino-o, Mino-o city, Osaka, Japan, 562

[21] Appl. No.: 271,547

[22] Filed: Jun. 8, 1981

[30] Foreign Application Priority Data

Mar. 13, 1981 [JP] Japan ..... 56-20904

[51] Int. Cl.[3] ..... A63B 57/00

[52] U.S. Cl. ..... 273/207

[58] Field of Search ..... 273/33, 203, 202, 204, 273/207–208, 209, 212, 26 R, 29 A, 25

[56] References Cited

U.S. PATENT DOCUMENTS

| | | | |
|---|---|---|---|
| 1,783,733 | 12/1930 | Manessero | 273/207 |
| 2,470,817 | 5/1949 | Hendricks | 273/207 |
| 2,839,304 | 6/1958 | Lerick | 273/207 |
| 4,192,504 | 3/1980 | Clugage | 273/33 |

FOREIGN PATENT DOCUMENTS

| | | | |
|---|---|---|---|
| 431204 | 7/1935 | United Kingdom | 273/207 |

*Primary Examiner*—Richard C. Pinkham
*Assistant Examiner*—T. Brown
*Attorney, Agent, or Firm*—George B. Oujevolk

[57] ABSTRACT

A golf tee comprising a peg member having one end adapted to be thrust into the ground, a head member for placement of a golf ball and an elastic member provided between the peg member and the head member, and which is characterized in that an axial bore is formed in said head member, said elastic member is inserted in said bore and pressed by a pressure member, and one end of said pressure member is secured in said peg member, whereby the lower end surface of said head member and the upper end surface of said peg member abut against each other.

1 Claim, 8 Drawing Figures

TILT TOP GULF TEE

BACKGROUND OF THE INVENTION

1. Field of the Invention

The present invention relates to an improvement of a golf tee, in which a head member for placement of a golf ball and an elastic member are adapted to slightly switch back and fourth upon receiving the impact of teeing off, and the elastic member disposed in the head member is maintained within the elastic deformation limit.

2. Prior Art

As shown in FIG. 1(*a*), in conventional golf tees, whether they are made of synthetic resins or woods, the peg portion 1 to be thrust into the ground and the head portion 2 for placement of a golf ball, are integrally formed.

With such a construction, the golf tee is likely to be withdrawn from the ground and thrown from the tee ground into the grass when the golf ball placed on the golf tee has been struck by a club head not squarely at the time of teeing off.

After ascertaining the direction of the driven golf ball, the player looks for the golf tee and often experiences difficulties in finding it. This frequently leads to an undesirable delay in the proceeding of the game.

In an attempt to solve the problem, a golf tee as shown in FIG. 1(*b*) has been proposed wherein a head portion 2 made of a resilient coil spring 3 for placement of a golf ball is attached to the other end of the peg portion.

However, such a golf tee has a drawback that, as the portion for placement of a golf ball is made of a coil spring, the spring is subject to permanent deformation upon receiving the impact at the time of teeing off, and it is likely that the deformed tee is no longer suitable for reuse.

SUMMARY OF THE INVENTION

The present invention provides a golf tee which comprises a peg member having one end adapted to be thrust into the ground, a head member for placement of a golf ball and an elastic member provided between the peg member and the head member, and which is characterized in that an axial bore is formed in the head member, said elastic member is inserted in said bore and pressed by a pressure member, and one end of said pressure member is secured in said peg member, whereby the lower end surface of said peg member and the upper end surface of said peg member abut against each other.

An object of the present invention is to present a golf tee which comprises a peg member, an elastic member, a pressure member and a head member for placement of a golf ball, wherein the upper end of the pressure member is hooked to the elastic member within said head member and the lower end thereof is secured in the peg member.

A further object of the present invention is to provide a golf tee whereby even when a portion of a club head other than the center of the club head has contacted a portion of the head for placement of a golf ball, only the golf ball is driven and the peg member remains as being thrust into the ground, and the elastic member is prevented by the pressure member from receiving a permanent deformation.

According to the present invention, a golf tee is provided which comprises an elongated peg member having one end adapted to be thrust into the ground and means for securing one end of a string for pressurizing the elastic member to a stopper inserted in the head member and securing the other end of said string to the peg member.

Said peg member has a hardness suitable for thrusting into the ground and its front end is suitably formed into a pin of a peg shape.

The material for the elastic member according to the present invention should preferably be a steel wire, a stainless wire or a wire coated with a synthetic resin.

Said elastic member is suitably formed of a resilient material coiled in a spiral form having a shape of a truncated cone or a cylinder in cross section.

Further, in order to prevent the possibility of deformation and incapability of regaining the original form, when the head member accomodating a coiled steel wire having such a shape of a truncated cone or a cylinder in cross section, has been hardly struck by a club head, the coiled steel wire is maintained within the elastic deformation limit by means of a pressure member comprising a plurality of connecting elements or an elongated string.

The peg member may be made of a synthetic resin or other materials such as a synthetic rubber.

DETAILED DESCRIPTION OF THE INVENTION

Figure 1A:
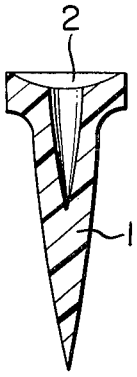
FIGS. 1(*a*) and 1(*b*) are cross sectional view of known golf tees.
Figure 1B:
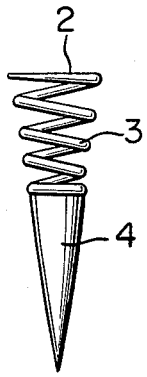

Now, preferred embodiments of the present invention will be described with reference to the drawings.

Numeral 10 designates a golf tee. The golf tee 10 may take suitable forms other than the form illustrated by the drawings.

The golf tee 10 comprises a peg member 11 having a cross sectional shape of an inverted triangle, an elastic member 12, a head member 13 for placement of a golf ball, and a pressure member 14.

The peg member 11 is made of a plastic material and has its front end forming a pin of a peg shape. A recess 15 is provided which axially extends from the rear end of the peg member, and a convex spherical surface 16 is formed at the rear end.

The elastic member 12 may be formed into a shape of pipe by winding a steel wire on the outer periphery a mandrel having a cross sectional shape of a cone to form an upper open end 17 and a lower open end 18.

The above mentioned head member 13 has a cross sectional shape of an inverted truncated cone. A concave 19 is formed on the top of said head member 13 so that a golf ball 20 may thereby readily be placed.

Numeral 20 designates a bore having a large diameter, which is formed axially through the center of the head member 13, and a hole having a smaller diameter is integrally formed to open to the bore 20. At the lower end of the head member 13, there is formed a concave spherical surface 22 having substantially the same radius of curvature as the convex spherical surface 16.

The pressure member 14 comprises a stopper 23 having a T-shape in cross section, a connecting element 26 of a S-shape hooked to the hooking hole 25 of the protrusion 24 of said stopper, and a spring hook 28 hooked to the hooking end 27 of said connecting element 26.

One end of said spring hook 28 is formed into a coiled portion 29 so that it is resiliently pushed in and hooked in the recess 15 of the above mentioned head member 11.

The length of said pressure member 14 and the connecting means are selected to ensure that at the time of having teed off, the elastic member is maintained within the elastic deformation limit and at the same time, the connecting portions are maintained in a movable state.

The function will be described.

At the time of teeing off, the peg 11 of the golf tee 10 is thrust into the ground in the same manner as for the conventional tees.

A golf ball 20 is placed on the concave 19 of the head member 13.

When the golf ball has been driven from the tee, the swinging motion of the head member 13 is minimial as it is limited by the elastic member 12 and the pressure member 14.

Even when a part of the driver head has contacted the head member 13 at the upper portion of the golf tee 10, only the golf ball 20 will be driven off, and the head member 13 will merely slightly swings along the convex spherical surface 16 of the recess 11 and will then swiftly swing back to the original position as the elastic member 12 is connected to said head member and the peg member 11 via the pressure member 14 and said elastic member is maintained within the elastic deformation limit.

The peg member 11 i.e. a pin is characterized in that it is held at a predetermined position.

Accordingly, there will be no need for looking around for the golf tee during the game, and therefore, it is possible to immediately proceed with the next action. This will promote the pleasure of golfing.

Figure 6:
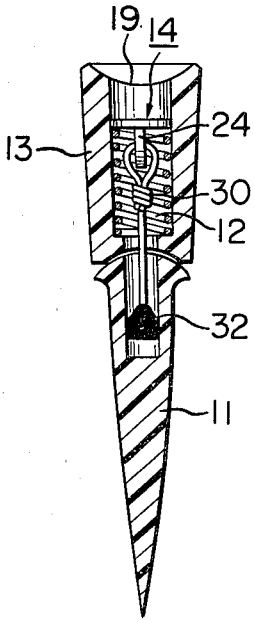
FIG. 6 and FIG. 7 are cross sectional views of other embodiments according to the present invention.
Figure 7:
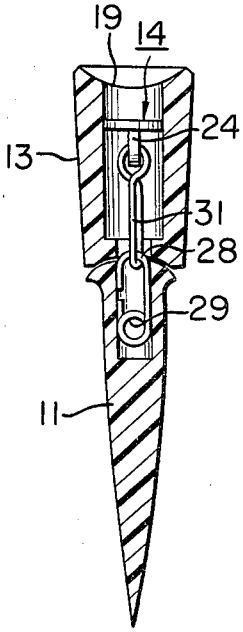

FIGS. 6 and 7 show other embodiments of the present invention, in which the same parts are represented by the same reference numerals.

Figure 3:
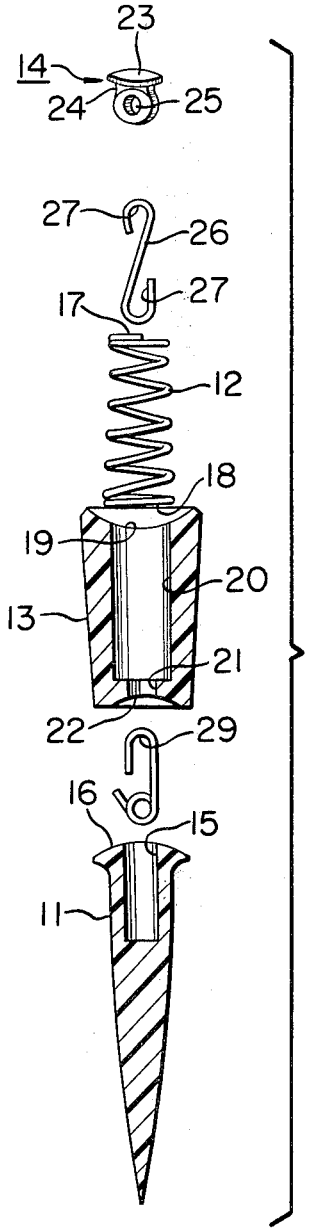
FIG 3 is an exploded partially cross-sectional perspective view of the golf tee according to the present invention.
Figure 2:
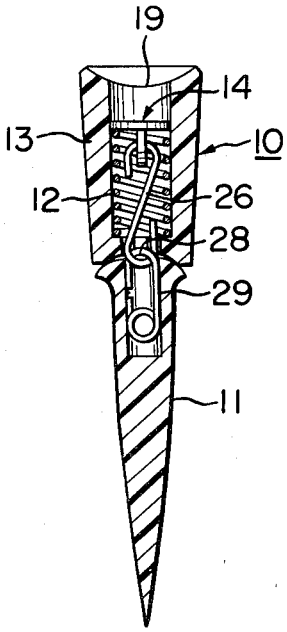
FIG. 2 is a cross sectional view of the golf tee of the present invention.
Figure 4:
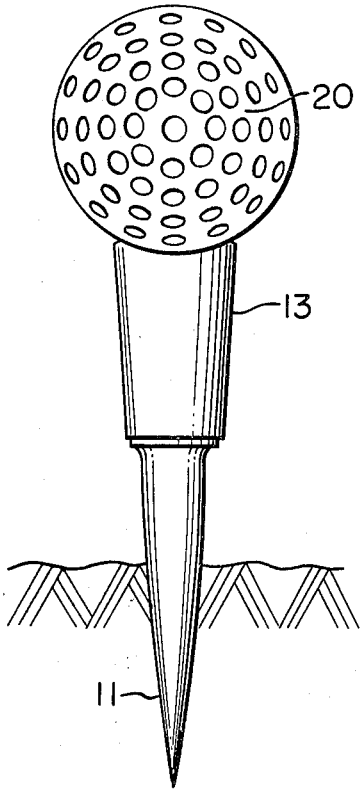
FIG. 4 is a front view of the golf tee of the present invention where the peg member is thrust into the ground.
Figure 5:
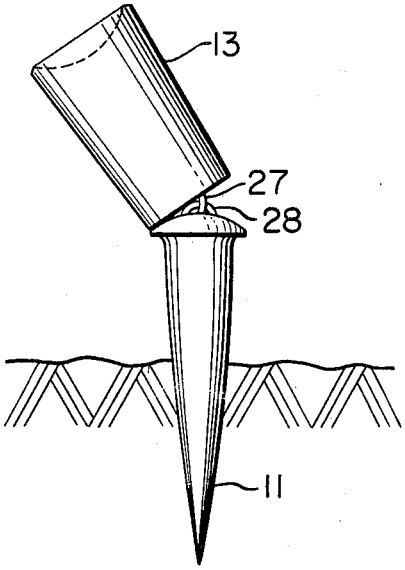
FIG. 5 is a front view illustrating the state at the time of having just teed off.

FIG. 6 shows a different embodiment of the pressure member 14, wherein a strong string 30 is used instead of the connecting element 26 and the spring hook 28 in FIGS. 2 and 3, and the upper end of said string 30 is secured to the stopper 23 of a T-shape in cross section and the lower end is secured in the recess 15 of the peg member 11.

In order to securely fix the string 30 in the recess 15 of the peg member 11, it is desirable to use a strong adhesive such as an epoxy resin.

Accordingly, the head member for placement of a golf ball acts in the same manner as described above when the ball has been teed off.

FIG. 7 shows a different embodiment of the elastic member and the pressure member, wherein an elastic rubber ring 31 is used instead of the coil spring type elastic member and said elastic rubber ring 31 acts also as a pressure member.

Namely, the upper end of the rubber ring 31 is secured to the stopper 23 of a T-shape in cross section, and the lower end is secured to the spring hook 28 which is pushed in and hooked in the peg member 11.

Further, the golf tee of the present invention is separated into two parts i.e. the upper and lower parts, and only the lower part is thrust into the ground. Accordingly, there is little resistance at the time of driving the ball from the tee, and the force of impact is wholly applied to the ball so that the ball is driven for a longer distance.

Accordingly, the same action as described above is performed with a ball has been teed off.

What is claimed is:

1: In a golf tee having a peg member including an elongated one end to be thrust into the ground, a head member for placement of a golf ball thereon, said head member having an axial bore formed therein, an elastic member disposed between the peg member and the head member, said elastic member being inserted in said bore, and, a pressure member which presses on said elastic member, and one end of said pressure member being secured to said peg member so that the lower surface of said head member and the upper surface of said peg member abut against each other, the improvement therein in which the pressure member comprises a stopper of a T-shape in cross section, a connecting element of a S-shape having one end hooked to said stopper, and a spring hook hooked to said connecting element.

* * * * *